United States Patent [19]

Yamamoto et al.

[11] Patent Number: 4,916,006

[45] Date of Patent: Apr. 10, 1990

[54] HEAT-SENSITIVE TRANSFER RIBBON

[75] Inventors: Kyoichi Yamamoto, Sagamihara; Akira Mizobuchi, Tokyo; Yasuo Sato, Funabashi; Takayasu Hirano, Chiba; Nobuhiko Ikebayashi, Hino; Hirokatsu Imamura, Tokyo, all of Japan

[73] Assignee: Dai Nippon Insatsu Kabushiki Kaisha, Japan

[21] Appl. No.: 130,871

[22] PCT Filed: Mar. 18, 1987

[86] PCT No.: PCT/JP87/00168

§ 371 Date: Nov. 13, 1987

§ 102(e) Date: Nov. 13, 1987

[87] PCT Pub. No.: WO87/05564

PCT Pub. Date: Sep. 24, 1987

[30] Foreign Application Priority Data

Mar. 18, 1986 [JP] Japan ..... 61-60185

[51] Int. Cl.[4] ..... B41M 5/26

[52] U.S. Cl. ..... 428/195; 428/327; 428/480; 428/483; 428/484; 428/488.4; 428/522; 428/523; 428/913; 428/914

[58] Field of Search ..... 428/195, 484, 488.1, 428/488.4, 914, 327, 480, 483, 522, 523, 913

[56] References Cited

U.S. PATENT DOCUMENTS 3,922,463 11/1975 Masaoki et al. ..... 428/323

4,064,304 12/1977 Fujita et al. ..... 428/207

*Primary Examiner*—Pamela R. Schwartz

*Attorney, Agent, or Firm*—Arnold, White & Durkee

[57] ABSTRACT

A heat-sensitive transfer recording material for use in a heat-sensitive transfer recording means such as a thermal printer is provided. The recording material comprises a heat-sensitive transfer ribbon having a heat-fusible ink layer provided on the surface of a polyester base film and a heat-resistant protective layer. The heat-resistant protective layer comprises (1) a chlorinated product of a 4-methyl-1-pentene polymer or a derivative thereof and an amorphous linear saturated polyester or (2) at least one member selected from the group consisting of chlorinated products of acid-modified 4-methyl-1-pentene polymers and acid-modified 4-methyl-1-pentent/α-olefin copolymers.

13 Claims, No Drawings

HEAT-SENSITIVE TRANSFER RIBBON

TECHNICAL FIELD

This invention relates to a heat-sensitive recording material which has excellent suitability for high-speed printing.

BACKGROUND ART

As one of outputting devices for personal computers or facsimiles, there is the printer. Together with the remarkable popularization of computer systems, printers for recording their outputs by visualization have been developed markedly. With the progress and development of technology, various recording systems have been practically applied, including the dot system, the typewriter system, the electrostatic copying system, the plotter system, etc., but the leading system is the dot system.

Of the dot systems, there are the ink jet system and the heat transfer recording system using a heat-sensitive transfer ribbon. Particularly, heat-sensitive transfer recording has been expected to be most promising for its maintenance-free characteristic, capability of using plain paper, speed-up suitability, easy reduction in cost of the device, etc.

However, in heat-sensitive transfer recording, there are still many demands for improvement of performance and quality by the user concerning the heat-sensitive transfer ribbon to be used. In general, heat-sensitive transfer recording uses a ribbon coated with a heat-fusible ink on one surface of a base film, namely, the system in which printing is effected by application of high heat on the thermal head. In this method, it is required that application of high heat by the thermal head be immediately transmitted to the heat-fusible ink layer on the opposite surface. For this purpose, the base film holding the heat-fusible ink layer is required to be made as thin as possible. However, when a synthetic resin film such as polyester film is made into a thin film, there is the problem that its strength and heat resistance will be inevitably lowered. Also, for corresponding to speed-up of recording, there is adopted the method in which the application time of heat on the thermal head is shortened by increasing the voltage applied, but in this case the surface temperature of the thermal head may sometimes become the melting point of the base film or higher. As a result, a part of the base film may melt. Even if it does not melt, it may be softened to increase frictional resistance between the film and a thermal head, whereby delivery of ribbon may be obstructed and give rise to such phenomena as temporary stopping of running at the thermal head or entanglement of the ribbon. This is the so-called sticking phenomenon, which is a serious problem in speedup of recording, and a base film with excellent heat resistance is needed for solving this problem.

The present invention solves such problems and provides a heat-sensitive transfer ribbon which is capable of performing heat transfer at high speed.

In a heat-sensitive transfer ribbon, in order to solve the problems of the prior art as described above, it has been considered to provide a heat-resistant protective layer on the back surface of the base film on which heat-fusible ink layer is provided. For example, as such a heat-resistant protective layer, it has been proposed to use an epoxy resin, a phenol resin or melamine resin, or to use a silicone resin, a fluorine resin, nitrocellulose or a polyimide resin, etc. (see Japanese Patent Publication No. 13359/1983).

The base film must be thin and strong, and a representative base film satisfying this condition is a polyester film.

For providing a heat-resistant layer comprising an epoxy resin or a phenol resin on such base film, it is a general practice to effect curing by heating after coating of the resin, but heat deformation occurs on the base film during the curing treatment according to such a method, and also smoothness of the surface is lost, whereby the film cannot have a uniform shape and properties as the heat-sensitive transfer ribbon.

On the other hand, in the case of using a silicone resin or urethane resin as the two-liquid type curable resin for avoiding high temperature heating, the time required for treatment becomes longer, or much labor is required for management of accurate control of the curing level (Japanese Laid-Open Patent Publication No. 196291/1984). Further, there is also a proposal to use a water-soluble resin as the heat-resistant protective layer, but in his case, since a water-soluble resin is employed, it is necessary to treat the surface of the coated film and crosslink the film to some extent by use of a crosslinking agent (Japanese Laid-Open Patent Publication No. 194893/1984).

We have made various studies in order to solve such problems, and our attention was drawn to the fact that a chlorinated product of a 4-methyl-1-pentene polymer which can be formed rapidly into a film at normal temperature to exhibit excellent heat resistance has been used and contained as the heat-resistant component in printing ink, and first investigated the separate coating of this film as the heat-resistant layer on the film surface of the polyester base film. However, this resin, while it can be caused to adhere onto a porous surface of cellulose type such as paper it cannot adhere at all onto a polyester film, and the film formed was also rigid and extremely brittle.

On the basis of a novel idea to use a 4-methyl-1pentene polymer which has been used only as the component contained in the ink composition of the prior art, singly as the component of the heat-resistant protective layer, we made further studies, and consequently found that by the use of a specific modified product of a 4-methyl-1pentene polymer or by the use of the modified product and a specific polyester resin in combination, a heat-resistant protective layer which has extremely firmly adhered onto the polyester base film surface and exhibits excellent heat resistance as well as excellent flexibility can be obtained.

DISCLOSURE OF THE INVENTION

The heat-sensitive transfer ribbon according to the present invention is a heat-sensitive transfer ribbon comprising a heat-fusible ink layer provided on one surface of a polyester base film and a heat-resistant protective layer on the other surface, characterized in that the above-mentioned heat-resistant protective layer contains a modified product of a 4-methyl-1-pentene polymer.

More specifically, the present invention can be constituted in the following two embodiments That is, the heat-sensitive transfer ribbon of the present invention according to the first embodiment comprises the above heat-resistant protective layer, which contains (a) a chlorinated 4-methyl-1-pentene polymer of a derivative thereof, (b) an amorphous linear saturated polyester and further, if necessary, (c) an additive such as lubricant, antistatic agent, back transfer preventive agent, etc.

Further, the heat-sensitive transfer ribbon of the present invention according to the second embodiment comprises the above heat-resistant protective layer, which contains (a) at least one polymer selected from the group consisting of chlorinated acid-modified 4-methyl-1-pentene polymers and chlorinated acid-modified 4-methyl-1-pentene/α-olefin copolymers and further, if necessary, (b) an additive such as lubricant, antistatic agent, back transfer preventive agent, etc.

BEST MODES FOR PRACTICING THE INVENTION

In the following, the constitution and preferable embodiments of the heat-sensitive transfer ribbon according to the present invention are described in detail.

Base film

In the present invention, as the base film for the heat-sensitive transfer ribbon, a polyester base film is used. Specifically, a crystalline linear polyester film such as polyethylene terephthalate (PET) or polybutylene terephthalate (PBT) is preferably used. This is because these films have the advantage of excellent strength as compared with other plastic films when thermal conductivity is improved by making the the film thinner.

The thickness of the polyester film used for the base film in the present invention is preferably in the range of about 1.6 μm to 10 μm.

Heat-resistant protective layer (1)

The heat-sensitive protective layer according to the first embodiment to be provided on the base film is prepared by forming a film by coating a composition comprising a mixture of (a) a chlorinated product of a 4-methyl-1-pentene polymer obtained by chlorination of 4-methyl-1-pentene polymer or its derivative and (b) an amorphous linear saturated polyester. By mixing both components, an unexpected effect of imparting flexibility and adhesiveness to the polyester base film without impairing the heat-resistance of the chlorinated 4-methyl-1-pentene polymer can be brought about, whereby many problems such as sticking or heat-resistance which could not be solved in the prior art can be solved.

Although the theoretical clarification of such effect exhibited cannot be fully made, according to the knowledge of the present inventors, the above effect has been confirmed to be exhibited by the heat-resistant protective layer which has a structure such that the amorphous linear saturated polyester is dispersed in fine particles incompatibly within the chlorinated 4-methyl-1pentene polymer. As estimated from this fact, it may be considered that the amorphous linear saturated polyester existing in spots with such phase separation is firmly adhering to the PET base film due to the anchoring effect simultaneously with plasticization of the brittle film of the chlorinated 4-methyl-1-pentene polymer, and also that heat resistance of the chlorinated 4-methyl-1-pentene polymer acts effectively on the surface on the thermal head side.

The chlorinated 4-methyl-1-pentene polymer (CMP) to be used in the first embodiment of the present invention refers to a polymer prepared by polymerization of 4-methyl-1-pentene which is dimer of propylene to prepare a poly-4-methyl-1-pentene, followed by chlorination thereof. A particularly preferable polymer may be obtained by dissolving a crystalline poly-4-methyl-1pentene with a melt flow rate (load: 5 kg/cm2, temperature: 260° C./ASTM D 1238: L) of 5 to 100 g/100 min in a chlorine/resistant solvent and chlorinating the polymer according to the uniform chlorination method to a chlorination degree of 50 wt.% or higher. At a chlorination degree less than 50 wt.%, heat resistance is inferior. Also, as its derivatives, there may be included those in which oxygen containing groups (e.g., carbonyl, carboxyl groups) are introduced into the polymer.

Also, the amorphous linear saturated polyester is of the same class as PET or PBT, but amorphous and linear saturated polyester is distinguished from crystalline polyester to be used for fibers or films, and it is not branched as an alkyd resin. A particularly preferable amorphous linear saturated polyester has a melt viscosity (load: 30 kg/cmz, temperature: 190° C./Koka system flow tester) of 1,500 to 5,000 poise. With a melt viscosity less than 1,500 poise, there is the drawback that heat resistance is impaired due to low polymerization degree.

The formulation ratio of the above chlorinated 4-methyl-1-pentene polymer and the amorphous linear saturated polyester is preferably in the range of 99:1 to 50:50 in terms of weight ratio. When the melt viscosity of the amorphous linear saturated polyester is low, its amount formulated may be smaller. The smaller the amount formulated the higher the heat resistance imparted.

In the heat-resistant protective layer, additional additive components as described below can be added if desired.

Heat-resistant protective layer (2)

The heat-resistant protective layer according to the second embodiment is a heat-resistant protective layer containing at least one polymer selected from acid-modified chlorinated 4-methyl-1-pentene polymers (ACMP) and acid-modified chlorinated 4-methyl-1-pentene/α-olefin copolymers (ACMPα).

That is, according to the knowledge of the present inventors, it has been found that the chlorinated resin of such an acid-modified product is highly heat-resistant and excellent in adhesion to the polyester base film surface and moreover can excellently follow the flexibility of the base film.

The chlorinated product of the acid-modified 4-methyl-1-pentene polymer and the chlorinated product of acid-modified 4-methyl-1-pentene/α-olefin copolymer to be used in such heat-resistant protective layer is obtained by graft polymerization of an unsaturated carboxylic acid or an unsaturated carboxylic anhydride onto a polymer prepared by homopolymerization of 4-methyl-1-pentene which is a dimer of propylene or a copolymerization together with an α-olefin under suspended state with a liquid as the medium in the presence of a radical polymerization initiator, followed further by chlorination.

A particularly preferable polymer is obtained by acid-modification of a crystalline 4-methyl-1-pentene polymer or a copolymer with an α-olefin having a melt flow rate (load: 5 kg/cm2, temperature: 260° C./ASTM D 1238: L) of 5 to 100 g/10 min, then dissolving the modified product in a chlorine-resistant solvent and chlorinating according to the uniform chlorination method to a chlorination degree of 50 wt.% or more. With a chlorination degree less than 50 wt.%, heat resistance is inferior.

Also, as the α-olefin to be copolymerized, α-olefins such as ethylene, propylene, butene, pentene, octene, decene and the like are suitable. Such an α-olefin is copolymerized in order to impart flexibility, and the proportion to be copolymerized is preferably 10 wt.% or lower in view of the fact that heat resistance will be lowered if it is too great.

As the unsaturated carboxylic acid or acid anhydride thereof to be used in acid modification, unsaturated monocarboxylic acids such as acrylic acid and methacrylic acid, unsaturated carboxylic acids such as maleic acid, fumaric acid, itaconic acid and citranic acid, and unsaturated dicarboxylic anhydrides such as maleic anhydride, itaconic anhydride and citranic anhydride can be employed.

By such acid modification, it may be considered that flexibility can be imparted by introduction of carboxyl groups, and at the same time excellent adhesive force is imparted to the polyester film due to the adhesiveness possessed by the functional groups. Accordingly, if the amount introduced is small, the adhesive force becomes insufficient, while on the contrary if it is too much, not only is adhesive force lowered, but also heat resistance becomes inferior. Accordingly, in view of this point, the amount of carboxyl groups introduced should be preferably such an amount that the unsaturated carboxylic acid or acid anhydride thereof will be in the range of 0.05 to 20 wt.% in the total polymer.

In a heat-sensitive transfer ribbon, for transmitting the heat to be applied as rapidly as possible, the polyester film which is the base material preferably should be as thin as possible. However, if the thickness of the film becomes 6 μm or less, the surface treatment with corona discharging will become extremely difficult, and also the mechanical characteristics of the film will be lowered by corona discharging treatment, and therefore the film is used without treatment in most cases. Since such film without treatment has less adhesiveness than a treated film, and therefore when such film without treatment is used as the base film, it is preferable to effect the above acid modification by polymerization of maleic acid, fumaric acid, itaconic acid or acid anhydride thereof rather than acrylic acid or methacrylic acid, and the chlorinated product of the dicarboxylic acid modified 4-methyl-1pentene polymer obtained by such acid modification (DACMP) or the chlorinated product of dicarboxylic acid modified 4-methyl-1-pentene/α-olefin copolymer (DACMPα) is superior in adhesiveness to the film without treatment and also has excellent heat resistance, therefore being particularly preferable. Although the theoretical clarification of this is not sufficiently made, it may be speculated as follows.

That is, acrylic acid or methacrylic acid is also itself homopolymerized to become a typical graft polymer. For this reason, it may be considered that the adhesiveness possessed inherently by the carboxyl group cannot be fully exhibited, and also it may be considered that the branch of polycarboxylic acid lowers heat resistance. In contrast, since unsaturated dicarboxylic acid such as maleic acid or itaconic acid or acid anhydride thereof does not undergo homopolymerization, and therefore each one monomer may be considered to be bonded by addition to 4-methyl-1-pentene polymer or olefin copolymer thereof, whereby it may be estimated that the adhesiveness possessed by the carboxyl group can be fully exhibited, and also heat resistance of the chlorinated product of 4-methyl-1-pentene polymer or α-olefin copolymer thereof will not be impaired.

As described above, depending on the kind of acid modification, the chlorinated product obtained cannot sometimes exhibit good adhesiveness with respect to the base film without corona discharging treatment. Therefore, in the heat-resistant protective layer according to the above second embodiment, for improvement of adhesiveness, it is preferable to incorporate an amorphous linear saturated polyester which has been added as the component in the heat-resistant protective layer according to the first embodiment as described above. As the amorphous linear saturated polyester as such additive component to be used in combination, the same as used in the heat-resistant protective layer according to the above first embodiment may be employed. Also, the properties, formulation ratio and its addition effect of the amorphous linear saturated polyester employed are also the same as in the case of the heat-resistant protective layer according to the above first embodiment In the heat-resistant protective layer, additional additive components as described below can also be added if desired.

Antistatic aqent

In the heat-resistant protective layer of the sensitive transfer ribbon of the present invention, an antistatic agent can be added if desired. In the heat-sensitive transfer ribbon as can be understood from its use mode, static electricity tends to accumulate in the heat-resistant protective layer of the base film. This causes films to attract each other electrically, whereby not only is operability during ribbon exchange worsened, but also static electricity generated during running may sometimes cause erroneous actuation of the thermal head to occur. Such troubles can be solved by the use of an antistatic agent. Examples of antistatic agents which can be used for such purpose are alkylammonium salts, polyoxyethylenealkylammonium salts, aliphatic amines, alkylsulfate salts, alkylbenzene sulfonates, alkyl naphthalene sulfonates, glycerine fatty acid esters, quaternary ammonium salts, imidazoline type amphoteric surfactants, alanine amphoteric surfactants, alkyldiethanolamide, alkylphosphoric acid diethanolamine salts and electroconductive carbon.

The antistatic agent as described above is a kind of surfactant except for electroconductive carbon. Most of such antistatic agents of surfactant type are hygroscopic and acquire electroconductivity by absorption of moisture in the air, and therefore they are greatly affected by changes in the surrounding temperature. Therefore, sufficient antistatic effect cannot be brought about at the time of low temperature in many cases.

In contrast, carbon black such as acetylene black, oil furnace black, or graphite powder is little changed in electroconductivity due to the influence of humidity as mentioned above, yet has good affinity with the resin, and also has excellent adhesiveness relative to the material to which it is to adhere and durability. Due to such advantages, carbon black is preferred as the antistatic component.

However, according to the knowledge of the present inventors, some carbon black have little effect of imparting electroconductivity depending on their properties, and therefore an amount as large as 35 to 60 wt. % must be formulated in order to obtain the desired value of the surface electrical resistance value of the heat-resistant protective layer of $10^9$ Ω/□ (coated thickness 0.5 μm) or less, and consequently there arises a problem in that the adhesiveness or strength of the heat-resistant protective layer will be adversely lowered.

The present inventors have also studied this point and consequently found that electroconductive carbon with a DBP oil absorption amount of 300 ml/100 g or more is particularly excellent as the antistatic agent to be added into the heat-resistant protective layer. The DBP oil absorption amount in this case is based on the value obtained according to the oil absorption measuring method A of JIS-K6221. Such electroconductive carbon has excellent electroconductivity, and is therefore particularly excellent on the point that the amount formulated in the heat-resistant protective layer can be made as small as possible. By use of such electroconductive carbon black, by incorporating this in an amount of only 5 to 30 wt.% in the heat-resistant protective layer, the surface resistance value of $10^9$ Ω/□ (coated film thickness 0.5 μm) practically required for the heat-sensitive transfer ribbon can be achieved, whereby a heat-sensitive transfer ribbon unaffected by temperature can be obtained.

A specific example of such electroconductive carbon black with a DBP oil absorption amount of 300 ml/100 g or more may be "Ketchen Black" (trade name, produced by Akzochemie Co., Holland) which is a special oil furnace black. As contrasted with the oil absorption amount of 50 to 150 ml/100 g of ordinary oil furnace black, the great DBP oil absorption amount of 300 ml/100 g or more exhibited by the above electroconductive carbon may be presumed to be due to the fact that the carbon particles have a structure construction, and at the same time the particles themselves have porous properties, thereby exhibiting excellent electroconductivity. Also, the heat-sensitive transfer ribbon using the electroconductive carbon black as described above as the antistatic agent has the advantage of small head friction.

Other additive components

In the heat-resistant protective layer of the heat-sensitive transfer ribbon of the present invention, a lubricant can be added if desired.

Unless the heat-sensitive transfer ribbon runs smoothly, sticking is liable to occur, and this can be solved by the use of a lubricant. Examples of the lubricant which can be used for such purpose are fine particulate lubricants such as polyethylene wax, paraffin wax, and other waxes, higher fatty acid amide, higher fatty acid ester, higher alcohol, lecithin, fluorine resin, vinylfluoride resin, silicone oil, silicone resin, silicone-modified various resins, guanamine resin, boron nitride, silica, talc, graphite, and molybdenum disulfide. An amount of the order of 1 to 30 wt.% in the heat-resistant protective layer is suitable. Also, these lubricants may be applied as coating on the heat-resistant protective layer.

Also, in the heat-resistant protective layer of the heat-sensitive transfer ribbon of the present invention, a back transfer preventive agent can be added if desired.

The heat-sensitive transfer ribbon is wound in the shape of a roll similarly as the ribbon for a typewriter, and the heat-resistant protective layer and the heat-fusible ink layer are in close contact with each other. When stored in a storehouse, etc., under such a state, a part of the heat-fusible ink layer may migrate to the heat-resistant protective layer under the influence of heat, pressure and time. As a consequence, the ribbon sliding roll of the printer may be contaminated, or residuum may adhere to the thermal head to impair thermal conductivity, or tackiness may cause generation of sticking. Such troubles can be solved by the use of a back transfer preventive agent. As an available back transfer preventive agent, a silicone-modified or fluorine-modified polymer with excellent surface orientation and persistent result thereof for a long term, it is preferable to use one having the structure of a graft or block copolymer. Its amount on the order of 0.1 to 5.0 wt.% in the heat-resistant protective layer is suitable. Also, these back transfer preventive agents may be formed as a coating on the heat-resistant protective layer.

Formation of heat-resistant protective layer

For formation of the heat-resistant protective layer on the base film, it is sufficient merely to dissolve the constituent components of the heat-resistant protective layer as described above in an organic solvent such as aromatic hydrocarbon type solvents, ester, ketone, and chlorinated hydrocarbons to prepare a solution for imparting heat resistance and to apply this to a thickness of the coating after drying of 0.1 to 5 μm, which step is followed by drying at normal temperature. By this, the heat-resistant protective layer can be caused to adhere to the base film very firmly.

Heat-fusible ink layer

As the heat-fusible ink to be formed on the other surface of the base film, all of the inks known in the art can be used. The heat-fusible ink composition can be prepared by formulating a colorant and a vehicle or binder and further other additives, if desired.

Specifically, as the heat-fusible ink, those prepared by melting waxes having appropriate melting points such as paraffin wax, microcrystalline wax, carunauba wax, etc., and mixing by melting carbon black, various paints or pigments thereinto.

As the heat-fusible ink composition to be used in the present invention, those having melt viscosities at 100° C. in the range of 10 cps to 60 cps are preferably used. An ink having a melt viscosity within this range has excellent sealing effects at the printed portion after transfer, thus being excellent in obtaining sharp printed images.

Further, in the present invention, a composite comprising a heat-fusible ink layer having a melting point of 40° to 80° C. and a sealing layer having a melting point of 50 to 100° C. and also having a melting point higher by 10 to 60° C. than said ink layer provided on the surface of the ink layer is preferably used. By providing a sealing layer with higher melting temperature than said ink layer on the surface of the ink layer, good sealing effect can be caused to be exhibited to further improve the printing quality. Such a sealing layer comprises various waxes and(or) resins, and further an extender pigment can be contained if necessary. As the colorant, of organic or inorganic pigments or paints, those having good characteristic as the recording material, for example, having sufficient color density without discoloration or fading by light, heat, humidity, etc., are preferred.

Also, substances which are colorless during nonheating but can form colors during heating or which can form colors by contact with the coated material on the transfer medium may be also employed. In addition to the colorants forming cyan, magenta, yellow, black, other colorants with various colors can be also used. Thus, in the heat-fusible ink, as the colorant, carbon black or various paints or pigments are selected and added corresponding to the color which is desired to be imparted to the ink.

As the vehicle, waxes, dry fats, resins, mineral fats, cellulose and derivatives of rubber, etc., and mixtures of these can be used.

Here, representative examples of wax are preferably microcrystalline wax, carunauba wax, paraffin wax, and otherwise various waxes can be used, including Fischer-Tropsch wax, various low molecular weight polyethylene and partially modified waxes, fatty acid esters, amides, wood waxes, beeswax, whale wax, insect wax, wool wax, shellac wax, candelilla wax, petrolatum, etc.

Here, as the resin, for example, EVA (ethylene-vinyl acetate copolymer), EEA (ethylene-ethyl acrylate copolymer), polyethylene, polystyrene, polypropylene, polybutene, petroleum resin, vinyl chloride resin, polyvinylalcohol, vinylidene chloride resin, methacrylic resin, polyamide, polycarbonate, fluorine resin, polyvinylformal, polyvinylbutyral, acetyl cellulose, nitrocellulose, vinyl acetate resin and polyisobutylene or polyacetal can be used.

Here, for imparting good thermal conductivity and fusion transferability to the ink layer, a thermal conductive substance can be formulated in the ink. As this substance, a carbonaceous substance such as carbon black or a metal powder such as that of aluminum or copper, tin oxide, molybdenum disulfide, can be employed.

Also, as the material to be used as the sealing layer for exhibiting the above sealing effect, one representative sealing agent is composed mainly of an emulsion type wax, which employs an emulsion of carunauba wax, microcrystalline wax, paraffin wax, polyethylene wax, etc. Similar waxes of the hot melt type and the hot lacquer type containing a solvent are also useable.

In the sealing agent, addition of an appropriate amount of an extender pigment is recommended. This is because blurring or tailing of printing can be prevented by doing so.

Details of the ink layer preferably used in the present invention as described above are disclosed in U.S. Pat. No. 766297.

Further, as the ink layer to be used in the present invention, those containing a compound of the formula (I) shown below as its binder component is also preferably used:

$$C_nH_{2n+1}CH_2Y \quad (I)$$

[wherein n is an integer of 21 to 50, and Y represents OH, $SO_3H$ or COOH or Ca, Al or Zn salts thereof].

As the compound of the above formula (I), particularly preferable are higher alcohols of Y=OH formed by oxidation and reduction of paraffins, which are compounds having molecular weights in the range of 750 to 900, or derivatives thereof.

By use of the above component as the binder, the melting point of the ink becomes sharp, whereby rapid transfer becomes possible at a relatively low temperature, whereby printing can be made further excellent with respect to speed-up and sharpening. Such constitution of ink composition is disclosed in U.S. Pat. No. 923386.

Direct or indirect coating of the heat-fusible ink layer onto the base film can be practiced by hot melt coating or otherwise conventional printing or coating method, specifically hot lacquer coating, gravure coating, gravure reverse coating, roll coating, gravure printing, bar coating and many other methods. The thickness should be determined so as to impart harmony between the necessary density of printing and heat sensitivity and is within the range of 0.1 to 30 μm, preferably 1 to 20 μm.

Matte layer

Heat-sensitive transfer generally has a gloss and is beautiful, but on the other hand, the printed matter may sometimes become difficult to read, and in such a case, matte printing is desirable In such a case, as proposed by the present applicant (Japanese Patent Application No. 208306/1983), a heat-sensitive transfer ribbon may be constituted by providing a matte layer by coating of a dispersion of an inorganic pigment such as silica or calcium carbonate in an appropriate solvent on the base film, and then providing a heat-fusible ink by coating thereon. Alternatively, the base film itself may be subjected to matte working and used (also the technique of Japanese Patent Application No. 208307/1983 according to the applicant's proposal is applicable).

Effect

The heat-sensitive transfer ribbon is superior in heat resistance to the ribbon of the prior art and therefore has good high-speed transfer performance without occurrence of sticking even when the temperature of the thermal head becomes higher. Also, since the base film can be made thin, transmission of heat is rapid, whereby a complicated pattern can be transferred at high speed sharply. Also, since the chlorinated product of 4-methyl-1-pentene polymer is not easily compatible with other resins, even when the roll of the heat-sensitive resin ribbon of the present invention is stored under a high temperature near the melting point of the wax, there occurs no blocking caused by melting of the wax, namely, the trouble of mutual adhesion of the wax layer on the front surface and the heat-resistant protective layer on the back surface. Also, in the preparation of the heat-sensitive transfer ribbon of the present invention, the heat-sensitive protective layer can be easily formed by coating by use of a conventional coating device such as gravure printing machine and drying the coating, without requiring special high heat treatment or aging step, and therefore the heat-fusible ink layer and the heat-resistant protective layer can be provided on the base film on the same line (in line). Therefore, various effects such as simple management of the steps and good production efficiency can be attained.

The present invention will be described in more detail by way of Examples and Comparative Examples.

EXAMPLE A-1

On one surface of a polyethylene terephthalate film with a thickness of 6 μm, a heat-fusible ink layer with a thickness of 5 μm comprising carbon black, carunauba wax, ester wax, oil, etc., was provided, and a heat-sensitive protective layer with a thickness of 0.5 μm was provided on the back surface by coating of a toluene solution of the mixed composition shown below followed by drying at normal temperature to prepare a heat-sensitive transfer ribbon.

| | |
|---|---|
| Chlorinated poly-4-methyl-1-pentene prepared by chlorination of crystalline | 95.0 parts by wt. |

-continued

| | |
|---|---|
| poly-4-methyl-1-pentene with a melt flow rate[1] of 10 g/10 min to chlorination degree of 65 wt. % | |
| Amorphous linear saturated polyester with a melt viscosity[2] of 1,600 poise | 5.0 parts by wt. |
| Monoalkyltrimethylammonium salt | 1.0 part by wt. |
| Silicone resin | 1.5 parts by wt. |

[1]Melt flow rate was measured according to ASTM D 1238: L under a load of 5 kg/cm$^2$ at a temperature of 260° C. (unit: g/10 min, hereinafter the same).
[2]Melt viscosity was measured by a Koka system flow tester under load of 30 kg/cm$^2$ at temperature of 190° C. (unit: poise, hereinafter the same).

○: good adhesion force
Δ: partly adhering
x: completely peeled off

Sticking:running test of NEC office line printer (thick film resister type) at D =max.
◉: no problem at all
○: practically no problem
Δ: sometimes sticking occurs
x: no running with complete fusion Transfer performance:
◉: complete solid printing possible
○:good pattern printing
x: printing impossible

TABLE 1

| Composition (wt. parts) | Example A-1 | Example A-2 | Example A-3 | Example A-4 | Comp. Example A-2 |
|---|---|---|---|---|---|
| Heat-resistant Protective Layer | | | | | |
| Heat-resistance imparting agent | | | | | |
| Chlorinated poly-4-methyl-1-pentene | 95 | 90 | 50 | 80 | "Provided |
| (Chlorination degree %) | (65) | (65) | (65) | (65) | with epoxy |
| (Melt flow rate g/10 min.) | (10) | (50) | (70) | (50) | resin layer" |
| Amorphous linear saturated polyester | 5 | 10 | 50 | 20 | |
| (melt viscosity poise) | (1600) | (4000) | (2500) | (2500) | |
| Antistatic agent | | | | | |
| Monoalkyltrimethylammonium salt | 1.0 | | | | |
| Aliphatic amine | | 1.0 | | | |
| Lubricant | | | 1.5 | | |
| Polyethylene wax | | | | | |
| Silicon resin | 1.5 | | | | |
| Back transfer preventive agent | | | | | |
| (Silicone/Acryl graft polymer) | | 1.0 | | | |
| Performance | | | | | |
| Adhesive force | ◉ | ◉ | ◉ | ◉ | Δ |
| Sticking | ◉ | ◉ | ○ | ◉ | x |
| Transfer performance | ◉ | ◉ | ○ | ◉ | x |

EXAMPLES A-2 to A-4

In Example A-1, the kinds and the amounts of chlorinated poly-4-methyl-1-pentene, amorphous linear saturated polyester and amounts of antistatic agent, lubricants, back transfer preventive agents added when desired were varied as shown in Table 1 to prepare heat-sensitive transfer ribbons.

Comparative Example A-1

Example A-1 was repeated except that no amorphous linear saturated polyester was used. However, this product after drying suffered from peel-off of both of the polyester base film and the heat-resistant protective layer due to poor adhesion therebetween.

Comparative Example A-2

On one surface of a PET film with a thickness of 6 μm, an epoxy resin was applied by coating to a thickness of 0.5 μm, and after curing by heating, a heat-fusible ink layer with a thickness of 5 μm comprising carbon black, carunauba wax, ester wax, oil, etc., was provided on the back surface to prepare a heat-sensitive transfer

Comparative tests

For the heat-sensitive transfer ribbons obtained in Examples A-1 to A-4 and Comparative Example A-2, adhesion force, sticking, transfer performance (printing quality) were measured. The results were as shown in Table 1. (Test methods)

Adhesion force: peel-off test by use of a cellotape with 25 mm width
◉: not peeled off at all

EXAMPLE B-1

On each one surface of a polyethylene terephthalate film subjected to corona discharging treatment with a thickness of 6 μm and a polyethylene terephthalate film thickness with no treatment with a thickness of 3.5 μm, a heat-fusible ink layer with a thickness of 5 μm comprising carbon black, carunauba wax, ester wax, oil, etc., and a heat-resistant protective layer with a thickness of 0.5 μm was provided by coating the back surface with a toluene solution of the mixed composition shown below, after which drying was carried out at room temperature to prepare two kinds of heat-sensitive transfer ribbons with different thicknesses.

| | |
|---|---|
| Chlorinated product of 4-methyl-1-pentene polymer modified with acrylic acid prepared by graft polymerization of 5 wt. % of acrylic acid onto crystalline poly-4-methyl-1-pentene with a melt flow rate of 10 g/10 min and then chlorinating the modified polymer to a chlorination degree of 65 wt. % (hereinafter called AACMP) | 87 parts by wt. |
| Ketchen black | 10 parts by wt. |
| Silicone resin | 2 parts by wt. |
| Silicone/acryl graft polymer | 1 part by wt. |

EXAMPLE B-2

Heat-sensitive transfer ribbons were prepared as in Example B-1 except for changing 10 parts by weight of Ketchen black to 5 parts by weight of monoalkyltrimethylammonium salt and 87 parts by weight of to 92 parts by weight in Example B-1.

EXAMPLE B-3

Heat-sensitive transfer ribbons were prepared as in Example B-1 except for using 87 parts by weight of a chlorinated product of an acrylic acid-modified 4-methyl-1-pentene/α-olefin copolymer (hereinafter called AACMPα) prepared by graft polymerizing 5 wt. % of acrylic acid onto a copolymer of 4-methyl-1-pentene and decene-1 copolymerized at a ratio of 95:5 (weight ratio) in place of 87 parts by weight of AACMP in Example B-1.

EXAMPLE B-4

Heat-sensitive transfer ribbons were prepared as in Example B-1 except for using 87 parts by weight of a chlorinated product of a maleic anhydride-modified 4-methyl-1-pentene polymer (hereinafter called MACMP) prepared by addition polymerization of 5 wt. % of maleic anhydride onto a crystalline poly-4-methyl-1-pentene with a melt flow rate of 30 g/10 min followed by chlorination to a chlorination degree of 65 wt. % in place of 87 parts by weight AACMP in Example B-1.

EXAMPLE B-5

Heat-sensitive transfer ribbons were prepared as in Example B-4 except for changing 10 parts by weight of Ketchen black to 5 parts by weight of monoalkyltrimethylammonium and 87 parts by weight of DACMP to 92 parts by weight in Example B-4.

EXAMPLE B-6

Heat-sensitive transfer ribbons were prepared as in Example B-4 except for using 87 parts by weight of a chlorinated product of a maleic anhydride-modified 4-methyl-1-pentene/α-olefin copolymer (hereinafter called DACMPα) prepared by addition polymerization of 5 wt. % of maleic anhydride onto a copolymer of 4-methyl-1-pentene and decene-1 copolymerized at a ratio of 95:5 (weight ratio) followed by chlorination to a chlorination degree of 65 wt. % in place of 87 parts by weight of DACMP in Example B-4.

EXAMPLE B-7

Heat-sensitive transfer ribbons were prepared as in Example B-1 except for changing the mixed composition used in Example B-1 as shown below.

| | |
|---|---|
| AACMP used in Example B-1 | 77 parts by wt. |
| Amorphous linear saturated polyester with melt viscosity of 1,600 poise | 10 parts by wt. |
| Ketchen black | 10 parts by wt. |
| Silicone resin | 2 parts by wt. |
| Silicone/acrylic graft polymer | 1 part by wt. |

EXAMPLE B-8

Heat-sensitive transfer ribbons were prepared as in Example B-7 except for changing 77 parts by weight of AACMP to 82 parts by weight of AACMPα used in Example 3, and using 5 parts by weight of an amorphous linear saturated polyester with a melt viscosity of 5,000 poise in place of 10 parts by weight of the amorphous linear saturated polyester with a melt viscosity of 1,600 poise in Example B-7.

EXAMPLE B-9

Heat-sensitive transfer ribbons were prepared as in Example B-7 except for changing 77 parts by weight of AACMP to 72 parts by weight of DACMP used in Example B-4 and changing 10 parts by weight of the amorphous linear saturated polyester with a melt viscosity of 1,600 poise to 15 parts by weight of one with a melt viscosity of 2,000 poise in Example B-7.

EXAMPLE B-10

Heat-sensitive transfer ribbons were prepared as in Example B-9 except for changing 72 parts by weight of DACMP to 72 parts by weight of DACMPα used in Example B-6 in Example B-9.

COMPARATIVE EXAMPLE B-1

Example B-1 was repeated except that 87 parts by weight of a chlorinated product (chlorination degree 65%) of a 4-methyl-1-pentene polymer without acid modification were used in place of 87 parts by weight of AACMP. However, this product after drying suffered from peel-off of both polyester base film and heat-resistant protective layer due to bad adhesion therebetween.

COMPARATIVE EXAMPLE B-2

On one surface of a PET film with a thickness of 6 μm, an epoxy resin was applied by coating to a thickness of 0.5 μm and after curing by heating, a heat-fusible ink with a thickness of 5 μm comprising carbon black, carunauba wax, ester wax, oil, etc., was provided on the back surface to prepare a heat-sensitive transfer ribbon.

COMPARATIVE EXAMPLE B-3

A heat-sensitive transfer ribbon was prepared in the same manner as in Example B-2 except for changing the epoxy resin to a urethane resin in Comparative Example B-2.

COMPARATIVE TESTS

For the heat-sensitive transfer ribbons obtained in Examples B-1 to B-10, Comparative Examples B-2 and B-3, adhesion force, sticking, transfer performance (printing quality) were measured. The results were as shown in Table 2.

Adhesion force: peel-off test by use of a cellotape with 25 mm width

◉: not peeled off at all
○: good adhesion force
Δ: partly adhering
x: completely peeled off Sticking:running test of NEC office line printer (thick film resister type) at D =max.

◉: no problem at all
○: practically no problem
Δ: sometimes sticking occurs
x: no running with complete fusion Transfer performance:

◉: complete solid printing possible
○:good pattern printing
x: printing impossible Surface electrical resistance value:

Heat-sensitive transfer ribbon stored under the conditions of a temperature of 30° C. and a relative humidity of 20% for 48 hours was measured by use of an insulating resistance measurement sample box (TR42: produced by Advantest K.K.), and a digital electrometer (TR8652: produced by Advantest K.K.) (unit:Ω/□).

TABLE 2

| Composition (wt. parts) | Example B 1 | 2 | 3 | 4 | 5 | 6 | 7 | 8 | 9 | 10 | Comparative Example B 2 | 3 |
|---|---|---|---|---|---|---|---|---|---|---|---|---|
| **Heat-resistance Protective Layer** | | | | | | | | | | | | |
| Heat resistance imparting agent | | | | | | | | | | | | |
| AACMP | 87 | 92 | | | | | 77 | | | | | |
| AACMPa | | | 87 | | | | | 82 | | | | |
| MACMP | | | | 87 | 92 | | | | 72 | | "provided with epoxy resin layer" | "provided with urethane resin layer" |
| MACMPa | | | | | | 87 | | | | 72 | | |
| (Acrylic acid modification degree %) | (5) | (5) | (5) | | | | (5) | (5) | | | | |
| (Maleic anhydride modification degree %) | | | | (5) | (5) | (5) | | | (5) | (5) | | |
| (Decene-1 copolymerization ratio %) | | | (5) | | | (5) | | (5) | | (5) | | |
| (Chlorination degree) | (65) | (65) | (65) | (65) | (65) | (65) | (65) | (65) | (65) | (65) | | |
| (Melt flow rate g/10 min.) | (10) | (10) | — | (30) | (30) | — | (10) | — | (30) | — | | |
| Amorphous linear saturated polyester (melt viscosity, poise) | | | | | | | 10 (1600) | 5 (5000) | 15 (2000) | 15 (2000) | | |
| Antistatic agent | | | | | | | | | | | | |
| Monoalkyltrimethyl Am salt | | 5 | | | 5 | | | | | | 5 | |
| Ketchen Black | 10 | | 10 | 10 | | 10 | 10 | 10 | 10 | 10 | | 10 |
| Lubricant | | | | | | | | | | | | |
| Silicone resin | 2 | 2 | 2 | 2 | 2 | 2 | 2 | 2 | 2 | 2 | 2 | 2 |
| Back transfer preventive agent | | | | | | | | | | | | |
| Silicone/acryl graft polymer | 1 | 1 | 1 | 1 | 1 | 1 | 1 | 1 | 1 | 1 | 1 | 1 |
| **Performance** | | | | | | | | | | | | |
| Adhesive force | | | | | | | | | | | | |
| Non-treated PET (3.5 μm) | ○ | ○ | ○ | ◉ | ◉ | ◉ | ◉ | ◉ | ◉ | ◉ | x | Δ |
| Treated PET (6 μm) | ◉ | ◉ | ◉ | ◉ | ◉ | ◉ | ◉ | ◉ | ◉ | ◉ | Δ | ○ |
| Sticking | ◉ | ◉ | ○ | ◉ | ◉ | ○ | ◉ | ○ | ◉ | ○ | x | x |
| Printing quality | ◉ | ◉ | ◉ | ◉ | ◉ | ◉ | ◉ | ◉ | ◉ | ◉ | x | x |
| Surface electrical resistance value Ω/□ | $10^5$ | $10^{13}$ | $10^5$ | $10^5$ | $10^{13}$ | $10^5$ | $10^5$ | $10^5$ | $10^5$ | $10^5$ | $10^{13}$ | $10^5$ |

EXAMPLE C-1

On one surface of a polyethylene terephthalate film with a thickness of 6 μm, a heat-fusible ink layer with a thickness of 5 μm comprising carbon black, carunauba wax, ester wax, oil, etc., was provided, and a heat-sensitive protective layer with a thickness of 0.5 μm was provided on the back surface by coating of a toluene solution of the mixed composition shown below followed by drying at normal temperature to prepare a heat-sensitive transfer ribbon.

| | |
|---|---|
| Chlorinated poly-4-methyl-1-pentene prepared by chlorination of crystalline poly-4-methyl-1-pentene with a melt flow rate of 10 g/10 min to chlorination degree of 65 wt. % | 95.0 parts by wt. |
| Amorphous linear saturated polyester with a melt viscosity of 1,600 poise | 5.0 parts by wt. |
| Ketchen black (DBP oil absorption amount 350 ml/100 g) | 1.0 part by wt. |
| Silicone resin | 1.5 parts by wt. |

EXAMPLES C-2 - C-4

In Example A-1, the kinds and the amounts of chlorinated poly-4-methyl-1-pentene, amorphous linear saturated polyester and amounts of antistatic agent, lubricants, back transfer preventive agents added when desired were varied as shown in Table 1 to prepare heat-sensitive transfer ribbons.

COMPARATIVE EXAMPLE C-1

Example C-1 was repeated except that no amorphous linear saturated polyester was used. However, this product after drying suffered from peel-off of both the polyester base film and the heat-resistant protective layer due to poor adhesion therebetween.

COMPARATIVE EXAMPLES C-2 - C-3

Heat-sensitive transfer ribbons were prepared by changing antistatic agents as shown in Table 3 in Example C-1.

COMPARATIVE EXAMPLE C-4

On one surface of a PET film with a thickness of 6 μm, an epoxy resin was applied by coating to a thickness of 0.5 μm, and after curing by heating, a heat-fusible ink layer with a thickness of 5 μm comprising carbon black, carunauba wax, ester wax, oil, etc., was provided on the back surface to prepare a heat-sensitive transfer ribbon.

COMPARATIVE TESTS

For the heat-sensitive transfer ribbons obtained in Examples C-1 to C-4, Comparative Example C-2, adhesion force, sticking, transfer performance (printing quality) were measured. The results were as shown in Table 3.

Adhesion force: peel-off test by use of a cellotape with 25 mm width
- ◉: not peeled off at all
- ○: good adhesion force
- Δ: partly adhering
- x: completely peeled off Sticking: running test of NEC office line printer (thick film resister type) at D = max.
- ◉: no problem at all
- ○: practically no problem
- Δ: sometimes sticking occurs
- x: no running with complete fusion Transfer performance:
- ◉: complete solid printing possible
- ○: good pattern printing
- x: printing impossible Surface electrical resistance value:

Heat-sensitive transfer ribbon stored under the conditions of a temperature of 30° C. and a relative humidity of 20% for 48 hours was measured by use of an insulating resistance measurement sample box (TR42: produced by Advantest K.K.), and a digital electrometer (TR8652 produced by Advantest K.K.) (unit:Ω/58 ).

TABLE 3

| Composition (wt. parts) | Example C-1 | Example C-2 | Example C-3 | Example C-4 | Comp. Example C-2 | Comp. Example C-3 | Comp. Example C-4 |
|---|---|---|---|---|---|---|---|
| | Heat-resistant Protective layer | | | | | | |
| Heat-resistance imparting agent | | | | | | | |
| Chlorinatd poly-4-methyl-1-pentene | 95 | 90 | 50 | 80 | 95 | 95 | |
| (Chlorination degree %) | (65) | (65) | (65) | (65) | (65) | (65) | |
| (Melt flow rate g/10 min.) | (10) | (50) | (70) | (50) | (10) | (10) | |
| Amorphous linear saturated polyester | 5 | 10 | 50 | 20 | 5 | 5 | |
| (melt viscosity poise) | (1600) | (4000) | (2500) | (2500) | (1600) | (1600) | |
| Antistatic agent | | | | | | | "Provided |
| Ketchen Black | 10 | 10 | 10 | 10 | | | with epoxy |
| Oil furnace black(*) | | | | | 10 | | resin |
| Monoalkyltrimethyl Am salt | | | | | | 5 | layer " |
| Lubricant | | | | | | | |
| Polyethylene wax | | | 1.5 | | | | |
| Silicone resin | 1.5 | | | | 1.5 | 1.5 | |
| Back transfer preventive agent | | | | | | | |
| (Silicone/acryl graft polymer | | 1.0 | | | 1.0 | 1.0 | |
| | | Performance | | | | | |
| Adhesive force | ◎ | ◎ | ◎ | ◎ | ◎ | ◎ | Δ |
| Sticking | ◎ | ◎ | ○ | ◎ | ◎ | ◎ | x |
| Transfer performance | ◎ | ◎ | ○ | ◎ | ◎ | ◎ | x |
| Surface electrical resistance value Ω/□ | $10^5$ | $10^5$ | $10^5$ | $10^5$ | $10^{12}$ | $10^{13}$ | — |

(*)DBP oil absorption amount 100 ml/100 g

EXAMPLE D-1

In Example B-1, an ink layer with a composition shown below was formed as the heat-fusible ink layer. This ink layer had a thickness of 4 μm and a melting point of 60° C.

| | |
|---|---|
| Carunauba wax | 20 parts |
| Paraffin wax (145° F.) (produced by Nippon Seiro Co.) | 60 parts |
| Carbon black "Sheest SO" (produced by Tokai Denkyoku Co.) | 15 parts |
| Ethylene-vinyl acetate copolymer "Evaflex 310" (produced by Mitsui Polychemical Co.) | 8 parts |

(product obtained by kneading by use of an attritor at 120° C. for 6 hours was applied at 120° C. according to the hot melt roll coating method).

On the above ink layer was further formed a sealing layer comprising the composition shown below. This sealing layer had a thickness of 0.5 μm and a melting point of 82° C.

| | |
|---|---|
| Carunauba emulsion "WE-90" (bond wax, aqueous emulsion with 40% or solids) | 10 parts |
| 60% aqueous isopropanol solution (coated by the gravure coating method) | 15 parts |

EXAMPLE D-2

In the above Example D-1, an ink composition for matte layer comprising the composition shown below was applied between the polyethylene terephthalate film and the ink layer to prepare a heat-sensitive transfer ribbon having a matte layer.

| | |
|---|---|
| Polyester resin "Byron 200" (produced by Toyobo Co.) | 6 parts |
| Vinyl chloride/vinyl acetate copolymer resin "Vinylite VA.GH" (produced by UCC) | 7 parts |
| Silica "Aerozil OK 412" (Nippon Aerozil) | 3 parts |
| Talc "Microace L-1" (produced by Nippon Talc Co.) | 1 part |
| Methyl ethyl ketone | 30 parts |
| Toluene | 30 parts |

After this composition was mixed with a 50% butyl acetate solution of "Takenate D-204" (produced by Takeda Chemical Industries) at a ratio of matte ink composition: isocyanate solution=20:3 (weight ratio), the mixture was applied by coating on the substrate. The amount was 1 g/m$^2$.

The heat-sensitive transfer ribbon thus obtained had good transfer characteristics, and printing readily readable applied with matte could be obtained.

INDUSTRIAL APPLICABILITY

As described above, the heat-sensitive transfer ribbon of the present invention has excellent heat resistance, and therefore it can be widely utilized for heat-sensitive transfer recording for which high-speed and high-quality printing are demanded.

We claim:

1. A heat-sensitive transfer ribbon having a heat-fusible ink layer produced on one surface of a polyester base film and a heat-resistant protective layer provided on the other surface, said heat-resistant protective layer comprising (a) a chlorinated 4-methyl-1-pentene polymer or a carbonyl or carboxyl derivative thereof, and (b) an amorphous linear saturated polyester.

2. A heat-sensitive transfer ribbon according to claim 1, wherein the heat resistant protective layer further comprises an additive having lubricant, antistatic or back transfer preventive properties.

3. A heat-sensitive transfer ribbon according to claim 1, wherein the heat-resistant protective layer has a structure such that the amorphous linear saturated polyester is dispersed in the form of fine particles in the chlorinated 4-methyl-1-pentene polymer.

4. A heat-sensitive transfer ribbon according to claim 1, wherein the antistatic agent comprises electroconductive carbon black.

5. A heat-sensitive transfer ribbon according to claim 1, wherein the antistatic agent comprises electroconductive carbon black with a DBP oil absorption amount of 300 ml/100 g or more as measured on the basis of JIS-K6221.

6. A heat-sensitive transfer ribbon according to claim 1, further comprising a matte layer positioned between the polyester base film and the heat-fusible ink layer

7. A heat-sensitive transfer ribbon according to claim 1, wherein matte working is applied on the surface of the polyester base film on the side where the heat-fusible ink layer is provided.

8. A heat-sensitive transfer ribbon according to claim 1, wherein a plurality of heat-sensitive ink layers colored with different colors are coated separately on the polyester base film, one of said heat-sensitive ink layers comprising said heat-fusible ink layer.

9. A heat-sensitive transfer ribbon having a heat-fusible ink layer provided on one surface of a polyester base film and a heat-resistant protective layer provided on the other surface, the heat-resistant protective layer comprising (a) at least one member selected from the group consisting of chlorinated acid-modified 4-methyl-1-pentene polymers and chlorinated acid-modified 4-methyl-1-pentene/$\alpha$-olefin copolymers.

10. A heat-sensitive transfer ribbon according to claim 9, wherein acid modification in the component (a) is a modification by addition of an unsaturated dicarboxylic acid or an unsaturated dicarboxylic anhydride.

11. A heat-sensitive transfer ribbon according to claim 9, wherein, said heat-resistant protective layer further comprises an amorphous linear saturated polyester.

12. A heat-sensitive transfer ribbon according to claim 9, wherein the heat-resistant protective layer has a structure such that the amorphous linear saturated polyester is dispersed in the form of fine particles in the component (a).

13. A heat-sensitive transfer ribbon according to claim 9, said heat-resistant protective layer further comprising an additive having lubricant, antistatic or back transfer preventive properties.

* * * * *